US005233947A

United States Patent [19]

Abe et al.

[11] Patent Number: 5,233,947

[45] Date of Patent: Aug. 10, 1993

[54] COOLING SYSTEM OF A CYLINDER OF AN INTERNAL COMBUSTION ENGINE

[75] Inventors: Shizuo Abe, Mishima; Masayoshi Tokoro, Susono; Masato Kawauchi, Mishima, all of Japan

[73] Assignee: Toyota Jidosha Kabushiki Kaisha, Aichi, Japan

[21] Appl. No.: 980,326

[22] Filed: Nov. 20, 1992

Related U.S. Application Data

[63] Continuation of Ser. No. 856,522, Mar. 24, 1992, abandoned.

[30] Foreign Application Priority Data

Mar. 29, 1991 [JP] Japan ..... 3-67018

[51] Int. Cl.[5] ..... F02F 1/14

[52] U.S. Cl. ..... 123/41.79

[58] Field of Search ..... 123/41.79, 41.83

[56] References Cited

U.S. PATENT DOCUMENTS 2,078,499 4/1937 Ljungstrom ..... 123/41.79

FOREIGN PATENT DOCUMENTS 168242 11/1988 Japan .

1-67448 7/1989 Japan .

*Primary Examiner*—Noah P. Kamen

*Attorney, Agent, or Firm*—Kenyon & Kenyon

[57] ABSTRACT

A cooling system of a cylinder liner of an internal combustion engine includes a plurality of first passages formed on an outer surface of the cylinder liner of the internal combustion engine and spaced apart from each other. A second passage is formed on the outer surface of the cylinder liner and runs in an axial direction of the cylinder liner, coupling the first passages to each other. The second passage receives, via an inflow part thereof, a coolant supplied in a traverse direction substantially perpendicular to the axial direction. A third passage is formed on the outer surface of the cylinder liner, and runs in the axial direction of the cylinder liner, coupling the first passages to each other. The third passage outputs the coolant received from the first passages to an outflow part thereof. The second passage has a traverse-sectional area which decreases as a distance of the traverse-sectional area from the inflow part increases. The third passage has a traverse-sectional area which decreases as a distance of the traverse-sectional area of the third passage from the outflow part increases.

13 Claims, 5 Drawing Sheets

COOLING SYSTEM OF A CYLINDER OF AN INTERNAL COMBUSTION ENGINE

This application is a continuation of application Ser. No. 07/856,522, filed on Mar. 24, 1992, now abandoned.

BACKGROUND OF THE INVENTION (1) Field of the Invention

The present invention generally relates to a cooling system of an internal combustion engine, and more particularly to a cooling system for cooling a cylinder by means of a coolant which flows in a passage formed on an outer surface of a cylinder liner.

(2) Description of the Related Art

Japanese Laid-Open Utility Model Application No. 63-168242 discloses a cooling system for cooling an internal combustion engine by passing a coolant through a spiral or ring-shaped passage formed on an outer surface of a cylinder liner.

FIGS. 1A, 1B and 1C are plan, front, and side views of a conventional cylinder liner, respectively. A plurality of ring passages 11 are spaced apart from each other at equal intervals in an axial direction of a cylinder liner 10, and are formed on an outer surface of the cylinder liner 10. All the passages 11 are coupled to each other by means of connection passages 12 and 13 formed in the axial direction of the cylinder liner 10. A traverse-sectional area of the connection passage 12 is uniform at any point thereof, and a traverse-sectional area of the connection passage 13 is also uniform at any point thereof.

The coolant is poured into the cylinder liner 10 in the traverse direction via an inflow part 14, and distributed into the passages 11 via the connection passage 12. The cylinder is cooled while the coolant is flowing in the passages 11. Then, the coolant passes through the connection passage 13 and is output via an outflow part The cooling system of the internal combustion engine is primarily intended to reduce a deformation of a cylinder (a variation in the cylinder bore) by uniformly cooling the entire cylinder bore. Generally, the cylinder has a thermal distribution varying in the axial direction thereof. More specifically, an upper portion of the cylinder has a high temperature, and a lower portion thereof has a low temperature. Hence, it is desired that the coolant be supplied to the cylinder liner 10 so that a flow rate change which matches the temperature distribution of the cylinder can be obtained. However, the conventional cooling system does not have a coolant flow-rate change that matches the temperature distribution of the cylinder.

SUMMARY OF THE INVENTION

It is a general object of the present invention to provide a cooling system in which the above disadvantage is eliminated.

A more specific object of the present invention is to provide a cooling system having a coolant rate change that matches the temperature distribution of the cylinder.

The above objects of the present invention are achieved by a cooling system of a cylinder liner of an internal combustion engine, the cooling system comprising:

a plurality of first passages formed on an outer surface of the cylinder liner of the internal combustion engine and spaced apart from each other;

a second passage formed on the outer surface of the cylinder liner, the second passage running in an axial direction of the cylinder liner and coupling the first passages to each other, the second passage receiving, via an inflow part thereof, a coolant supplied in a traverse direction substantially perpendicular to the axial direction; and a third passage formed on the outer surface of the cylinder liner, the third passage running in the axial direction of the cylinder liner and coupling the first passages to each other, the third passage outputting the coolant received from the first passages to an outflow part thereof.

In the above structure, the second passage has a traverse-sectional area which decreases as a distance of the traverse-sectional area of the second passage increases away from the inflow part, and the third passage has a traverse-sectional area which decreases as a distance of the traverse-sectional area of the third passage increases away from the outflow part.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

A disadvantage of the prior art will now be described.

Figure 1A:
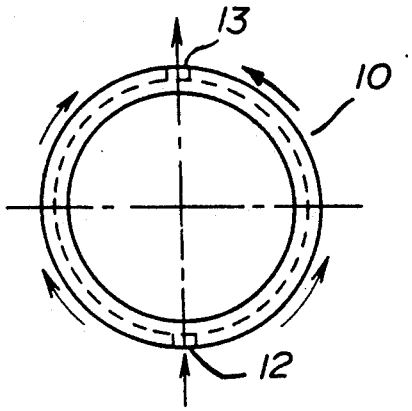
FIG. 1A PRIOR ART
FIGS. 1A, 1B and 1C are respectively plan, front and side views of a conventional cooling system of an internal combustion engine.
Figure 1B:
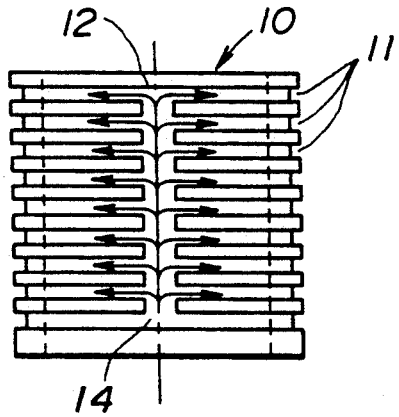
FIG. 1B PRIOR ART
Figure 1C:
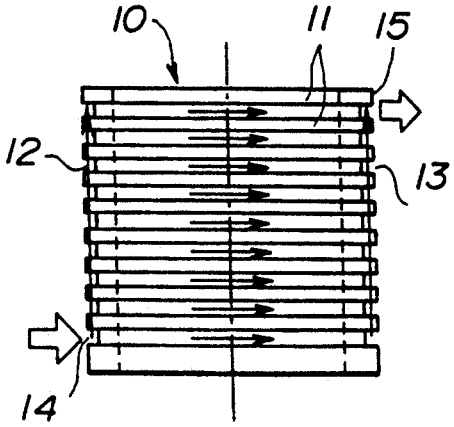
FIG. 1C PRIOR ART
Figure 2:
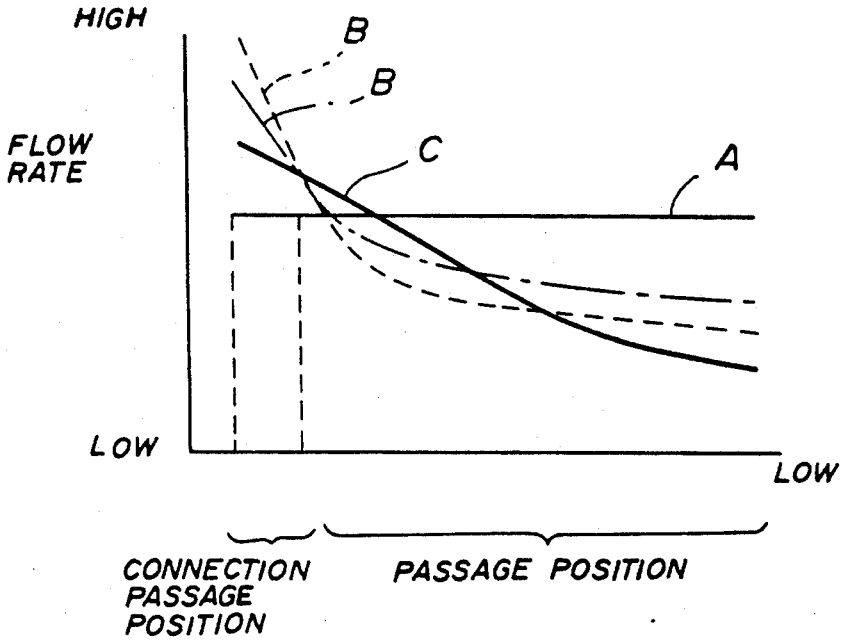
FIG. 2 is a graph showing a relationship between a flow rate and a passage position.

FIG. 2 is a graph showing the relationship between the flow rate and the position of the passages 11 of the cylinder liner 10. A curve C shows the most suitable relationship for uniformly cooling the cylinder bore. Hereinafter, the relationship shown by the curve C is referred to as an ideal characteristic. As shown in FIG. 2, the curve C of the ideal characteristic changes so that a flow rate obtained at an upper portion of the cylinder is higher than that obtained at a lower portion thereof, and the flow rate gradually increases from the lower portion to the upper portion of the cylinder.

It is possible to change the flow rate of the coolant flowing in each passage 11 by changing the traverse-sectional area of each of the connection passages 12 and 13. A curve A shows a characteristic obtained when each of the connection passages 12 and 13 has a large traverse-sectional area, and curves B1 and B2 show a characteristic obtained when the connection passages 12 and 13 have small traverse-sectional areas. Regarding each of the characteristics illustrated by curves A, B1, B2 and C, each of the connection passage 12 and 13 has a constant traverse-sectional area at any point thereof.

When the traverse-sectional area of each of the connection passages 12 and 13 is sufficiently large (curve A), a loss of pressure does not occur in each connection passage. Hence, the flow rate is constant at any point of each connection passage, as shown by the curve A. When the traverse-sectional area of each of the connection passages 12 and 13 is small (curves B1, B2), a loss of pressure takes place in each connection passage, and the flow rate decreases as the position of the passages 11 becomes lower, as shown by the curves B1 and B2. Further, the flowing direction of the coolant is greatly changed at a portion of the connection passage 13 into which the coolant is poured in the traverse direction via the inflow part 14. As a result, a great loss of pressure takes place at this portion of the connection passage 13, and hence the flow rates obtained at the passages 11 located at intermediate and lower portions of the cylinder are decreased.

Regarding the characteristic A, the flow rate obtained at an upper portion of the cylinder liner 10 is smaller than that of the ideal characteristic C, and the flow rate obtained at a lower portion thereof is greater than that of the ideal characteristic C. For each of the characteristics B1 and B2, the flow rate obtained at the upper portion of the cylinder liner 10 is greater than that of the ideal characteristic C, and the flow rate obtained at the lower portion thereof is smaller than that of the ideal characteristic C. It can be concluded from the above discussion that the conventional cooling system is not capable of distributing the coolant to the passages 11 so that the ideal characteristic C can be obtained. If the cylinder is not suitably cooled, friction and coil consumption will increase.

FIGS. 3A through 3D are diagrams of a first embodiment of the present invention. As shown in FIGS. 3A through 3D, a plurality of passages 22 of a cooling system 20 are vertically spaced apart from each other at equal intervals, and are formed on an outer surface of a cylinder liner 21 formed in a cylinder block 30. Connection passages 23 and 24 are formed on the outer surface of the cylinder liner 21 so that they run in the axial direction of the cylinder line 21, and are arranged in a line. The passages 22 are coupled to the connection passages 23 and 24. An inflow part 25 is formed at an upper portion of the connection passage 23 into which a coolant is poured. An outflow part 26 is formed at an upper portion of the connection passage 24 from which the coolant goes out of the cylinder liner 21.

Figure 3A:
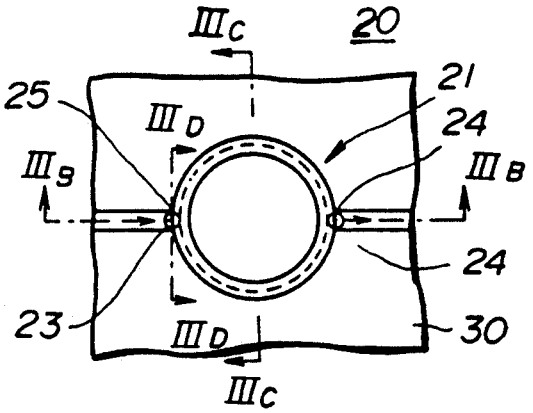
FIG. 3A is a plan view of a first embodiment of the present invention.
Figure 3B:
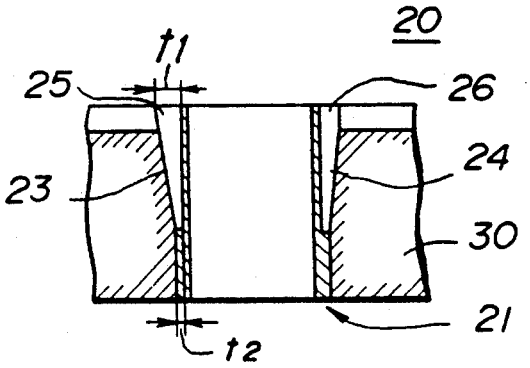
FIG. 3B is a longitudinal-sectional view taken along a line $III_B$—$III_B$ shown in FIG. 3A.
Figure 3C:
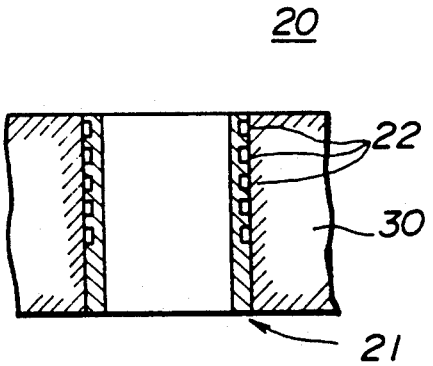
FIG. 3C is a longitudinal-sectional view taken along a line $III_C$—$III_C$ shown in FIG. 3A.
Figure 3D:
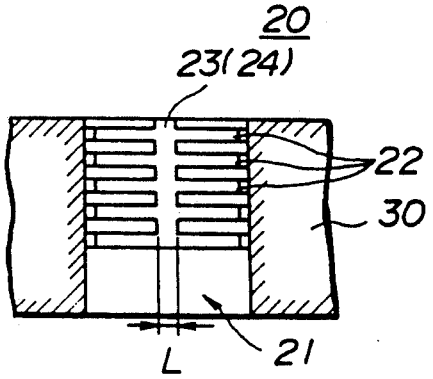
FIG. 3D is a side view having a longitudinal-sectional view taken along a line $III_D$—$III_D$ shown in FIG. 3A.

The connection passages 23 and 24 include an essential feature of the present invention. As shown in FIG. 3B, a maximum traverse-sectional area of the connection passage 23 is obtained at the inflow part 25, and similarly a maximum traverse-sectional area of the connection passage 24 is obtained at the outflow part 26. It will be noted that the traverse-sectional area is included in a plane orthogonal to the axial axis of the cylinder liner 21. A reference $t_1$ denotes the largest diameter of each of the connection passages 23 and 24 at which the maximum traverse-sectional area is obtained. The traverse-sectional area of the connection passage 23 gradually decreases with increasing distance from the inflow part 25, along the axial axis thereof. A minimum traverse-sectional area of the connection passage 23 is obtained at the lowest portion thereof. A reference $t_2$ denotes the smallest diameter of each of the connection passages 23 and 24 at which the minimum traverse-sectional area is obtained. In other words, each of the connection passages 23 and 24 has a substantially triangular longitudinal-sectional area, or a tapering inner wall. Similarly, a minimum traverse-sectional area of the connection passage 24 is obtained at the lowest portion thereof. In the embodiment shown in FIGS. 3A through 3C, the diameter of each of the connection passages 23 and 24 obtained at intermediate portions thereof are almost the same as the smallest diameter $t_2$. The diameter of the connection passage 23 (labeled "L") measured along the line $III_D$—$III_D$ (FIG. 3A) orthogonal to the line $III_B$—$III_B$ is constant at any position of the connection passage 23. In this regard, the connection passage 24 is formed in the same manner as the connection passage 23.

Figure 4:
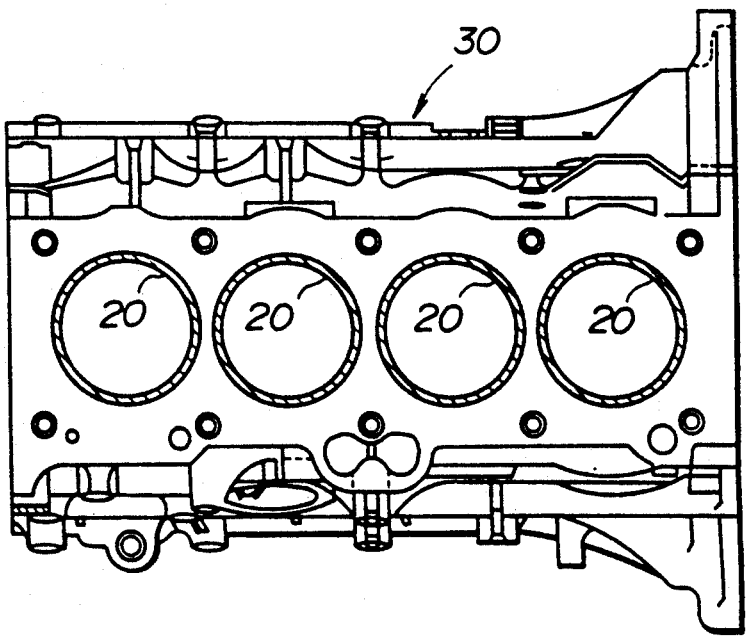
FIG. 4 is a diagram showing a state where cylinder liners are fastened to a cylinder block.

As shown in FIG. 4, the above-mentioned cylinder liner 21 is inserted into one of four bores formed in the cylinder block 30. The other three cylinder liners formed in the same manner as the cylinder liner 21 are inserted into the other bores of the cylinder block 30. The coolant poured into the connection passage 23 via the inflow part 25 formed at the upper portion thereof is distributed to the passages 22, and then output, via the connection passage 24, to the outflow part 26 formed at the upper portion thereof. The coolant poured into the connection passage 23 via the inflow part 25 encounters a small resistance in its curving path, since the connection passage 23 has the maximum traverse-sectional area at the inflow part 25 (that is, the largest diameter). Hence, the loss of pressure obtained at the inflow part 25 is small, and a flow rate smaller than that for the conventional system can be obtained at the upper portion of the connection passage 23. This means that the characteristic B1 or B2 is made close to the ideal characteristic C at the upper portion of the cylinder liner 21.

The loss of pressure generated at a center portion of the connection passage 23 is smaller than that generated at the upper portion thereof. With this arrangement, the coolant flows in the connection passages 22, which are connected to the connection passage 23 at the center portion thereof, at increased flow rates. This means that the characteristic B1 or B2 is made close to the ideal characteristic C at the center portion of the cylinder liner 21.

The above-mentioned mechanism, related to the connection passage 23, substantially holds true for the connection passage 24.

As described above, it becomes possible to make the flow rate change of the coolant flowing around the cylinder liner 21 close to the ideal characteristic C by narrowing the traverse-sectional area of each of the connection passages 23 and 24 as their distance from the upper portions thereof increases. That is, the traverse-sectional area of the connection passage 23 decreases from the upstream side (the upper portion thereof) to the downstream side (the lower portion thereof). Similarly, the traverse-sectional area of the connection passage 24 decreases from the upstream side (the lower portion thereof) to the downstream side (the upper portion thereof). Hence, it becomes possible to uniformly cool the entire length of the cylinder liner 21 and thus reduce friction and oil consumption.

Figure 5A:
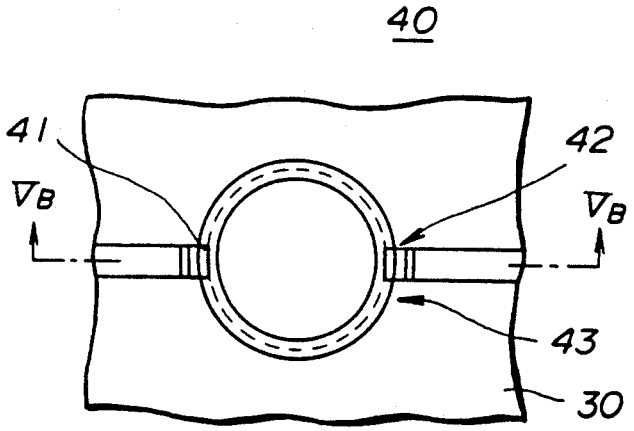
FIG. 5A is a plan view of a second embodiment of the present invention.
Figure 5B:
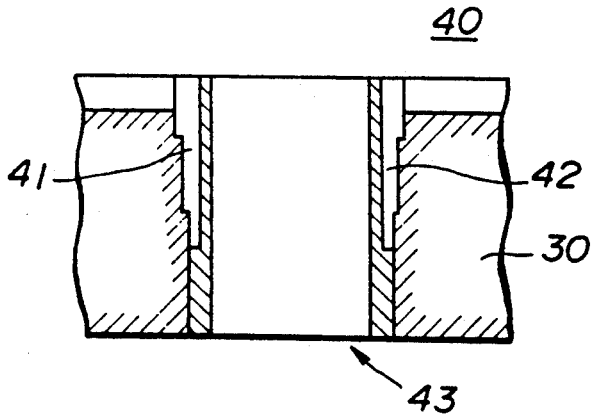
FIG. 5B is a longitudinal-sectional view taken along a line $V_B$—$V_B$ shown in FIG. 5A.

FIGS. 5A and 5B show a second embodiment of the present invention. In the first embodiment shown in FIGS. 3A through 3D, the traverse-sectional area of each of the connection passages 23 and 24 gradually decreases as its distance from the inflow part 25 and the outflow part 26 increases. In the second embodiment of the present invention shown in FIGS. 5A and 5B, the traverse-sectional area of each of the connection passages 23 and 24 decreases stepwise as its distance from the inflow part 25 and the output part 26 increases. The structures of the connection passages 23 and 24 shown in FIGS. 5A and 5B have almost the same advantages as those of the connection passages 23 and 24 shown in FIGS. 3A through 3D. It will be easier to produce the stepwise structures of the cylinder blocks shown in FIGS. 5A and 5B, as compared with the tapering inner wall of each of the connection passages 23 and 24.

Figure 6A:
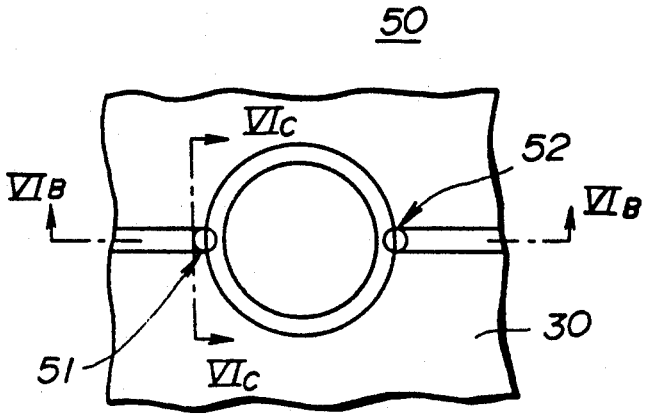
FIG. 6A is a plan view of a third embodiment of the present invention.
Figure 6B:
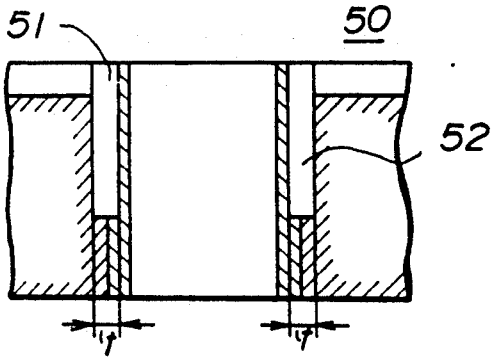
FIG. 6B is a longitudinal-sectional view taken along a line $VI_B$—$VI_B$ shown in FIG. 6A.
Figure 6C:
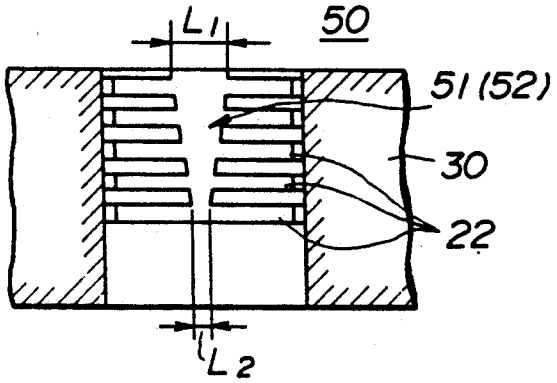
FIG. 6C is a side view showing a longitudinal-sectional view taken along a line $VI_C$—$VI_C$ shown in FIG. 6A.

FIGS. 6A through 6C show a third embodiment of the present invention. As shown in FIG. 6B, a connection passage 51 has a fixed diameter, measured along the line $VI_B$—$VI_B$, at upper and center portions of the connection passage 51. The fixed diameter obtained at the upper and center portions of the connection passage 51 is larger than a fixed diameter obtained at a lower portion thereof. As shown in FIG. 6C, the diameter of the connection passage 51, measured along the line $VI_C$—$VI_C$, gradually decreases as a distance of the cross-section taken along line $VI_C$—$VI_C$ increases away from an inflow part of the connection passage 51. A maximum diameter L1 of the connection passage 51 is obtained at the inflow part, and a diameter L2 thereof, smaller than L1, is obtained at the center portion thereof. The diameter L2 is the same as that obtained at the lower end of the cylinder liner 43. The structure shown in FIGS. 6A and 6B has almost the same advantages as those of the first embodiment of the present invention.

The present invention is not limited to the specifically disclosed embodiments, and variations and modifications may be made without departing from the scope of the present invention.

What is claimed is:

1. A cooling system of a cylinder liner of an internal combustion engine, said cooling system comprising:

a plurality of first passages formed on an outer surface of the cylinder liner of the internal combustion engine and spaced apart from each other;

a second passage formed on the outer surface of the cylinder liner, said second passage running in an axial direction of the cylinder liner and coupling the first passages to each other, said second passage receiving, via an inflow part thereof, a coolant supplied in a traverse direction substantially perpendicular to the axial direction; and a third passage formed on the outer surface of the cylinder liner, said third passage running in the axial direction of the cylinder liner and coupling the first passages to each other, said third passage outputting the coolant received from the first passages to an outflow part thereof, wherein:

the second passage has a traverse-sectional area which decreases as a distance of the traverse-sectional area from said inflow part increases; and the third passage has a traverse-sectional area which decreases as a distance of the traverse-sectional area of the third passage from said outflow part increases.

2. A cooling system as claimed in claim 1, wherein:

said second passage has a diameter which gradually decreases as the distance of the traverse-sectional area of said second passage from said inflow part increases; and said third passage has a diameter which gradually decreases as the distance of the traverse-sectional area of said third passage from said outflow part increases.

3. A cooling system as claimed in claim 2, wherein the diameter of each of said second and third passages is a diameter measured in the traverse direction.

4. A cooling system as claimed in claim 3, wherein:

said second passage has a fixed diameter measured in a direction perpendicular to the traverse direction and the axial direction; and said third passage has a fixed diameter measured in the direction perpendicular to the traverse direction and the axial direction.

5. A cooling system as claimed in claim 2, wherein the diameter of each of said second and third passages is a diameter measured in a direction perpendicular to the traverse direction and the axial direction.

6. A cooling system as claimed in claim 5, wherein:

said second passage has a fixed diameter measured in the traverse direction; and said third passage has a fixed diameter measured in the traverse direction.

7. A cooling system as claimed in claim 1, wherein:

a diameter of said second passage obtained on an upstream side thereof and measured in the traverse direction is larger than that obtained on a downstream side thereof; and a diameter of said third passage obtained on an upstream side thereof and measured in the traverse direction is larger than that obtained on a downstream side thereof.

8. A cooling system as claimed in claim 1, wherein:

said second passage has a substantially triangular longitudinal-sectional area taken along a first line running in the traverse direction; and said third passage has a substantially triangular longitudinal-sectional area taken along the first line.

9. A cooling system as claimed in claim 8, wherein:

said second passage has a substantially rectangular longitudinal-sectional area taken along a second line perpendicular to the first line; and said third passage has a substantially rectangular longitudinal-sectional area taken along the second line.

10. A cooling system as claimed in claim 1, wherein:

said second passage has a diameter which stepwise decreases in the axial direction of the cylinder liner; and said third passage has a diameter which stepwise decreases in the axial direction of the cylinder liner.

11. A cooling system as claimed in claim 10, wherein:

a diameter of said second passage measured in the traverse direction decreases stepwise from an upstream side of said second passage to a downstream side thereof; and a diameter of said third passage measured in the traverse direction decreases stepwise from an upstream side of said third passage to a downstream side thereof.

12. A cooling system as claimed in claim 1, wherein:

said second passage has an approximately fixed traverse-sectional area at a downstream portion thereof; and said third passage has an approximately fixed traverse-sectional area at an upstream portion thereof.

13. A cooling system as claimed in claim 1, wherein said second and third passages are fastened to upper portions of the cylinder liner and are arranged in a line.

* * * * *

UNITED STATES PATENT AND TRADEMARK OFFICE

CERTIFICATE OF CORRECTION

PATENT NO. : 5,233,947
DATED : August 10, 1993
INVENTOR(S) : Shizuo ABE, et al.

It is certified that error appears in the above-indentified patent and that said Letters Patent is hereby corrected as shown below:

Column 1, line 38, after "part" insert --15--.

Signed and Sealed this

Seventeenth Day of May, 1994

Bruce Lehman

*Attest:*

BRUCE LEHMAN

*Attesting Officer*

*Commissioner of Patents and Trademarks*